US009893446B1

(12) United States Patent
Wu et al.

(10) Patent No.: US 9,893,446 B1
(45) Date of Patent: Feb. 13, 2018

(54) HIGH SPEED CONNECTOR AND TRANSMISSION MODULE THEREOF

(71) Applicant: Greenconn Corp., New Taipei (TW)

(72) Inventors: Kun-Shen Wu, New Taipei (TW); Keh-Chang Cheng, New Taipei (TW)

(73) Assignee: GREENCONN CORP., New Taipei (TW)

( * ) Notice: Subject to any disclaimer, the term of this patent is extended or adjusted under 35 U.S.C. 154(b) by 0 days.

(21) Appl. No.: 15/633,137

(22) Filed: Jun. 26, 2017

(51) Int. Cl.

| | |
|---|---|
| ***H01R 12/70*** | (2011.01) |
| ***H01R 13/6599*** | (2011.01) |
| ***H01R 12/50*** | (2011.01) |
| ***H01R 12/73*** | (2011.01) |
| ***H01R 12/71*** | (2011.01) |
| ***H01R 12/72*** | (2011.01) |
| ***H01R 12/00*** | (2006.01) |

(52) U.S. Cl.
CPC ..... *H01R 12/737* (2013.01); *H01R 12/00* (2013.01); *H01R 12/712* (2013.01); *H01R 12/716* (2013.01); *H01R 12/724* (2013.01); *H01R 13/6599* (2013.01); *H01R 23/688* (2013.01); *H01R 12/50* (2013.01); *H01R 12/70* (2013.01)

(58) Field of Classification Search
CPC ..... H01R 13/6599; H01R 12/50; H01R 12/70
See application file for complete search history.

(56) References Cited

U.S. PATENT DOCUMENTS

| | | | | |
|---|---|---|---|---|
| 6,413,103 | B1 * | 7/2002 | Merz | G06F 1/1616 174/117 FF |
| 6,544,072 | B2 * | 4/2003 | Olson | H01R 13/6599 439/108 |
| 7,156,690 | B2 * | 1/2007 | Tolmie | G02B 6/3817 439/439 |
| 7,371,128 | B2 * | 5/2008 | DeLessert | G01R 1/06772 439/700 |
| 2003/0129872 | A1 * | 7/2003 | Tolmie | G02B 6/3817 439/577 |

* cited by examiner

*Primary Examiner* — Briggitte R Hammond
(74) *Attorney, Agent, or Firm* — Li & Cai Intellectual Property (USA) Office

(57) ABSTRACT

A high speed connector includes a housing, an insulating core inserted into the housing, a plurality of first conductive terminals and a plurality of second conductive terminals fixed on the insulating core, and a shielding member. The first conductive terminals arranged in one row parallel to a width direction includes two differential signal terminals and two grounding terminals respectively arranged at two opposite outer sides of the differential signal terminals. The shielding member includes a base portion detachably assembled to the housing and a metallic coating layer coated on the base portion. The metallic coating layer contacts the two grounding terminals to establish an electrical connection between the two grounding terminals. The metallic coating layer is arranged at the two opposite outer sides of the differential signal terminals, and the metallic coating layer is configured to shield the differential signal terminals in the width direction.

10 Claims, 11 Drawing Sheets

HIGH SPEED CONNECTOR AND TRANSMISSION MODULE THEREOF

BACKGROUND OF THE INVENTION

1. Field of the Invention

The present disclosure relates to a connector; in particular, to a high speed connector and a transmission module thereof.

2. Description of Related Art

A conventional high speed connector is provided with a grounding sheet to connect with a plurality of grounding terminals thereof, thereby reducing insertion loss and cross-talk. A conventional grounding sheet has a sheet portion and a plurality of elastic arms integrally extended from the sheet portion. The elastic arms are formed in a cantilever beam mode, and are integrally formed with the sheet portion by using a punching process. However, the conventional grounding sheet does not have a good structural strength, and is not formed with any portion to shield the differential signal terminals of the conventional high speed connector. Thus, the performance of the conventional high speed connector cannot be increased by improving the conventional grounding sheet.

SUMMARY OF THE INVENTION

The present disclosure provides a high speed connector and a transmission module thereof to solve the drawbacks associated with conventional high speed connectors.

The present disclosure discloses a high speed connector including a housing, an insulating core, a plurality of first conductive terminals, a plurality of second conductive terminals, and a shielding member. The insulating core is inserted into the housing. The first conductive terminals are fixed on the insulating core and are arranged in one row parallel to a width direction. Each of the first conductive terminals is substantially arranged in the housing. The first conductive terminals include two differential signal terminals and two grounding terminals, and the two grounding terminals are respectively arranged at two opposite outer sides of the two differential signal terminals. The second conductive terminals are fixed on the insulating core and are arranged in one row parallel to the width direction. Each of the second conductive terminals is substantially arranged in the housing, and a length of each of the second conductive terminals is less than or equal to that of each of the first conductive terminals. The shielding member includes a substrate and a metallic coating layer. The substrate is detachably fastened to the housing. The metallic coating layer is coated on the substrate, and is abutted against the two grounding terminals to establish an electrical connection between the two grounding terminals. The metallic coating layer is arranged at the two opposite outer sides of the two differential signal terminals. The metallic coating layer is configured to shield the two differential signal terminals in the width direction.

The present disclosure also discloses a transmission module of a high speed connector. The transmission module includes an insulating core, two differential signal terminals and two grounding terminals, and a shielding member. The differential signal terminals and the two grounding terminals are fixed on the insulating core and are arranged in one row parallel to a width direction. The two grounding terminals are respectively arranged at two opposite outer sides of the two differential signal terminals. The shielding member includes a substrate and a metallic coating layer. The metallic coating layer is coated on the substrate, and is abutted against the two grounding terminals to establish an electrical connection between the two grounding terminals. The metallic coating layer is arranged at the two opposite outer sides of the two differential signal terminals. The metallic coating layer is configured to shield the two differential signal terminals in the width direction.

In summary, for the high speed connector (or the transmission module) in the present disclosure, the shielding member has a shielding function for the differential signal terminals by using the metallic coating layer, so that the quality and the performance of signal transmission of the high speed connector (or the transmission module) can be effectively improved. Moreover, for the high speed connector (or the transmission module) in the present disclosure, the substrate having a better structural strength can be configured to support the metallic coating layer by coating the metallic coating layer on the substrate, so that the metallic coating layer is not easily deformed.

In order to further appreciate the characteristics and technical contents of the present disclosure, references are hereunder made to the detailed descriptions and appended drawings in connection with the present disclosure. However, the appended drawings are merely shown for exemplary purposes, and should not be construed as restricting the scope of the present disclosure.

DETAILED DESCRIPTION OF THE PREFERRED EMBODIMENTS

References are hereunder made to the detailed descriptions and appended drawings in connection with the present disclosure. However, the appended drawings are merely provided for exemplary purposes, and should not be construed as restricting the scope of the present disclosure.

Figure 1:
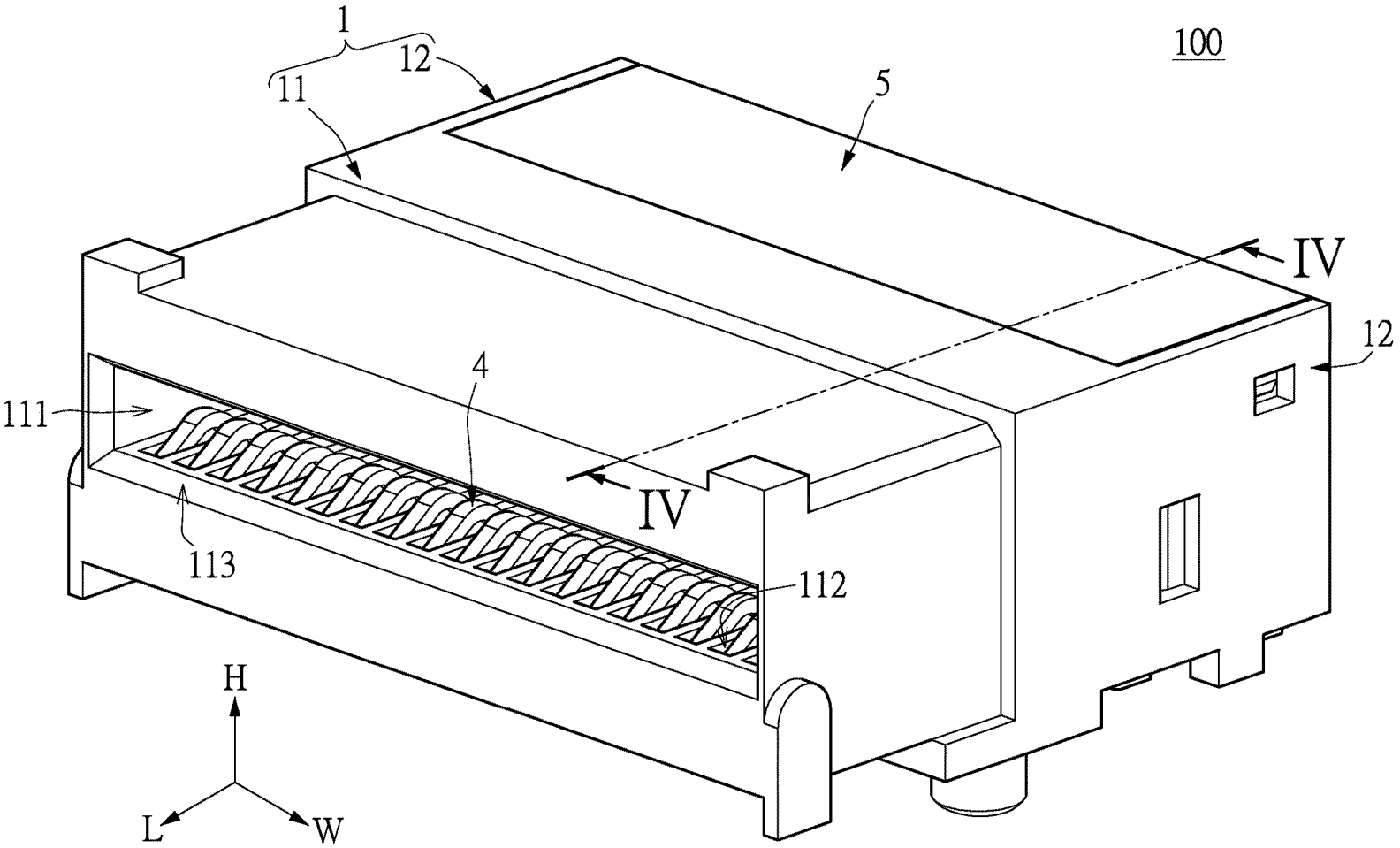
FIG. 1 is a perspective view showing a high speed connector according to the present disclosure.
Figure 2:
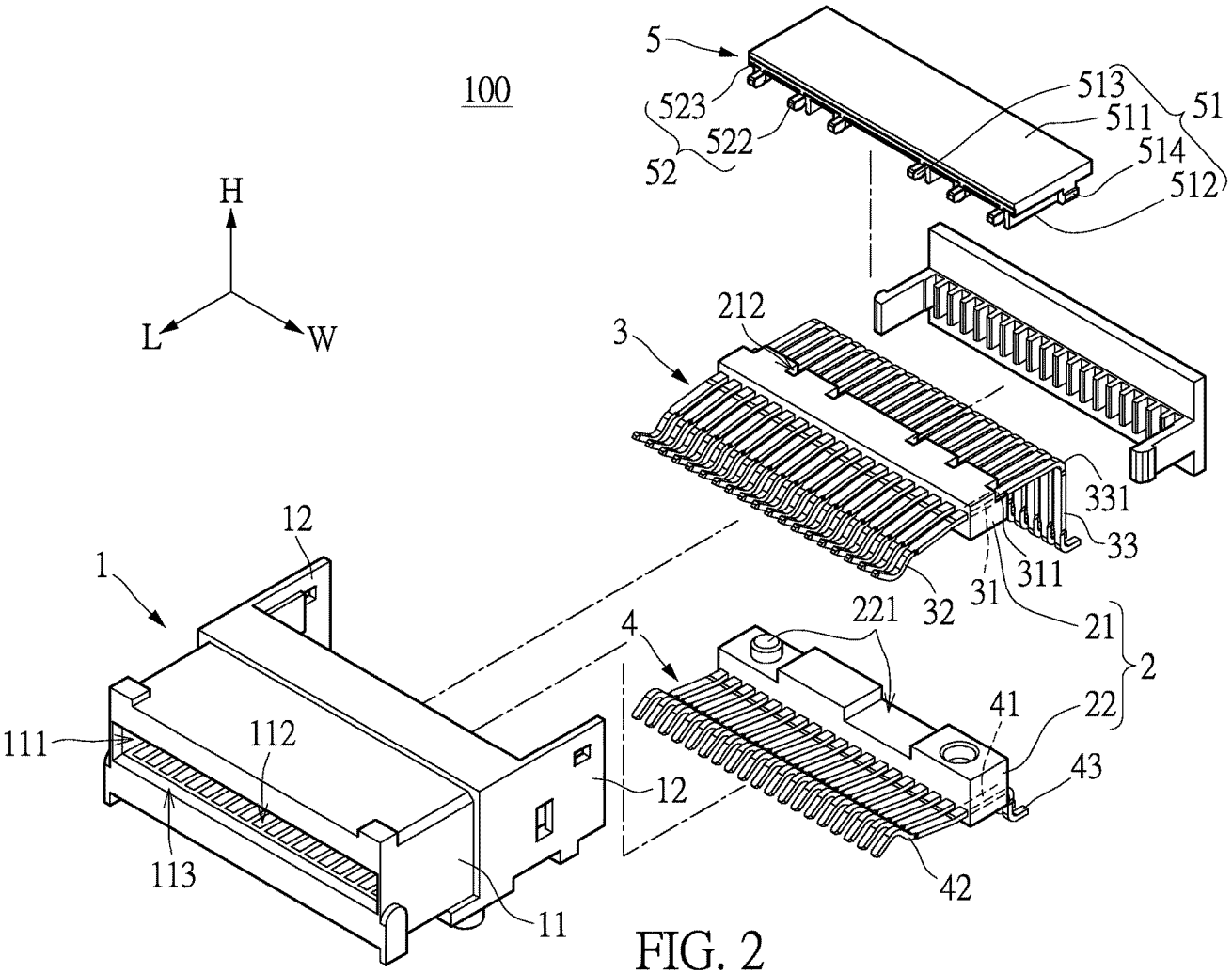
FIG. 2 is an exploded view of FIG. 1.
Figure 3:
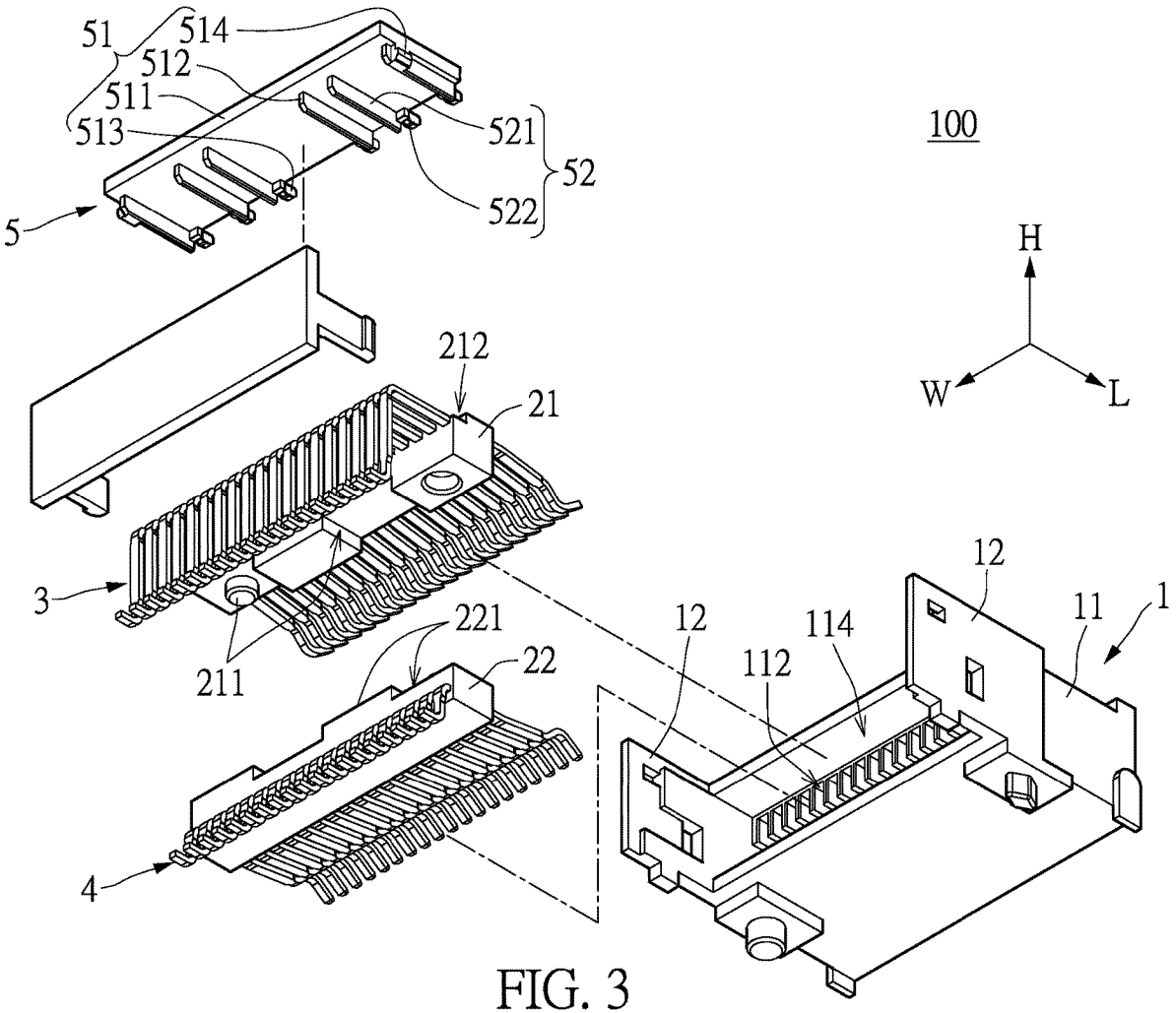
FIG. 3 is an exploded view of FIG. 1 from another perspective.

Reference is made to FIGS. 1 to 11, which illustrate an embodiment of the present disclosure. As shown in FIGS. 1 to 3, the present embodiment discloses a high speed connector 100; in particular, to a right angle connector, but the present disclosure is not limited thereto. For example, in other embodiments of the present disclosure, the high speed connector 100 can be a vertical connector. The high speed connector 100 in the present embodiment includes a housing 1, an insulating core 2 inserted into the housing 1, a plurality of first conductive terminals 3 fixed on the insulating core 2, a plurality of second conductive terminals 4 fixed on the insulating core 2, and a shielding member 5 detachably fastened to the housing 1. The following description discloses the structure and connection relationships of each component of the high speed connector 100.

Figure 4:
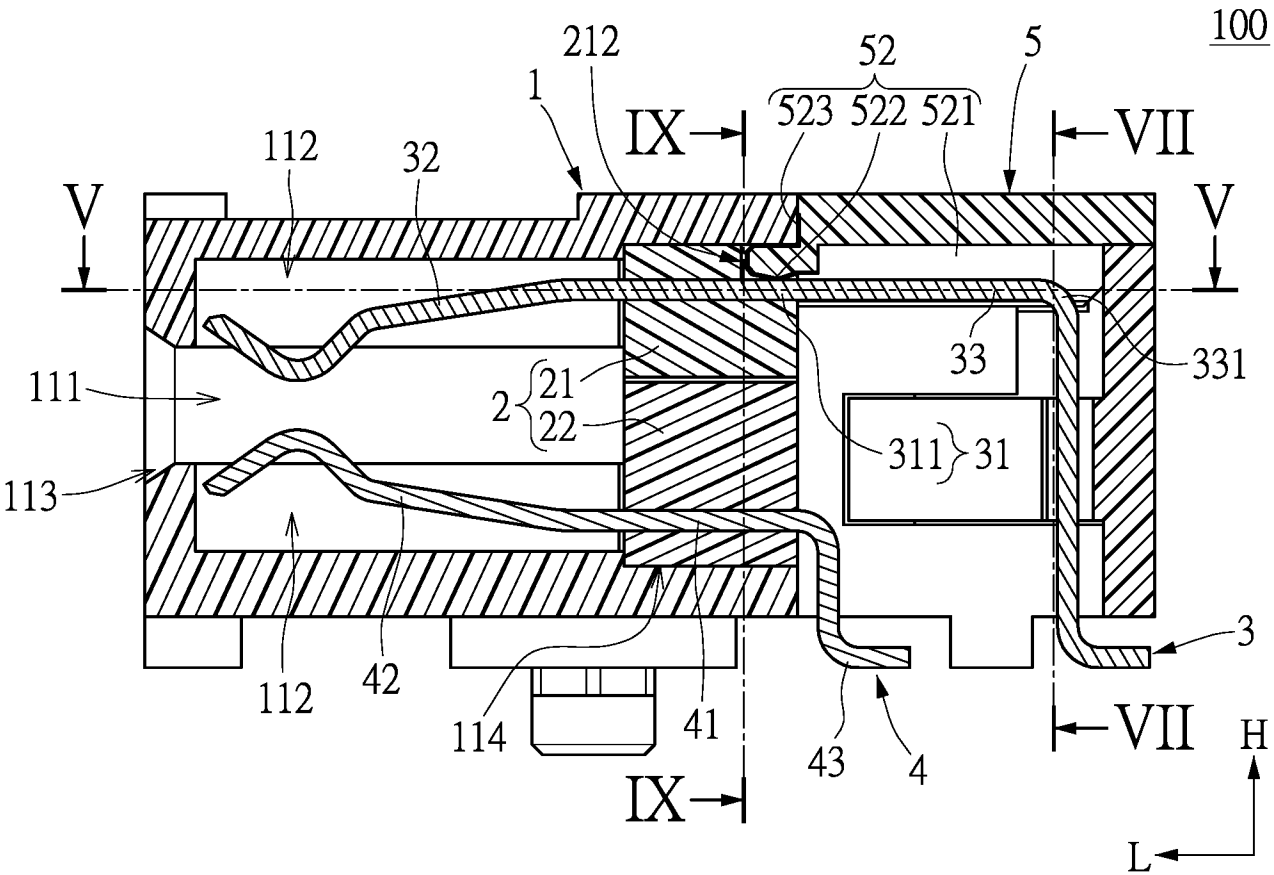
FIG. 4 is a cross-sectional view taken along a cross-sectional line IV-IV of FIG. 1.

In order to clearly describe the present embodiment, the housing 1 defines a width direction W, a longitudinal direction L, and a height direction H, the latter three of which are perpendicular to each other. As shown in FIGS. 2 to 4, the housing 1 includes a main portion 11 and two positioning sheets 12 respectively extended from two opposite sides of a rear end of the main portion 11. The main portion 11 has an inserting channel 111 and a plurality of terminal slots 112 arranged in two rows. The two rows of the terminal slots 112 are respectively arranged above and under the inserting channel 111, and are in air communication with the inserting channel 111. Each row of the terminal slot 112 is arranged in the width direction W of the housing 1. The main portion 11 has an inserting opening 113 formed on a front end thereof and a receiving slot 114 formed on the rear end thereof. The inserting opening 113 and the receiving slot 114 are respectively arranged at a front side and a rear side of the inserting channel 111, and are in in air communication with the inserting channel 111.

As shown in FIGS. 2 to 4, the insulating core 2 is inserted into the housing 1, and the insulating core 2 in the present embodiment is inserted into the receiving slot 114 of the housing 1 to be a boundary of the inserting channel 111, but the present disclosure is not limited thereto. The insulating core 2 includes a first plastic core 21 and a second plastic core 22. The first plastic core 21 has a rugged structure 211, the second plastic core 22 has a mating structure 221, and the first plastic core 21 is fixed on the second plastic core 22 by detachably inserting the rugged structure 211 into the mating structure 221.

In addition, the insulating core 2 in the present embodiment adapts the first plastic core 21 and the second plastic core 22 inserted into the first plastic core 21, but the present disclosure is not limited thereto. That is to say, the insulating core 2 can be adjusted according to practical needs. In other embodiments of the present disclosure, the insulating core 2 can be integrally formed as one piece.

As shown in FIGS. 2 to 4, the first conductive terminals 3 are arranged in one row parallel to the width direction W, and are fixed on the first plastic core 21. Each of the first conductive terminals 3 is substantially arranged in the housing 1. Each of the first conductive terminals 3 has a first embedded segment 31 fixed and embedded in the first plastic core 21 of the insulating core 2, a first contacting segment 32 extended from the first embedded segment 31 toward the inserting opening 113, and a first fixing segment 33 extended from the first embedded segment 31 in a direction away from the inserting opening 113. That is to say, the first contacting segments 32 are respectively arranged in the upper row of the terminal slots 112 of the main portion 11, and each of the first contacting segments 32 is partially located in the inserting channel 111. The first fixing segments 33 are arranged between the two positioning sheets 12. Specifically, each of the first fixing segments 33 has a bending corner 331 arranged behind a portion thereof extended from the respective embedded segment 31 in the longitudinal direction L. In other words, each of the first fixing segments 33 has a first portion (not labeled) extended from the respect embedded segment 31 in the longitudinal direction L, a second portion parallel to the height direction H (not labeled), and the bending corner 331 connected to the first portion and the second portion.

Figure 7:
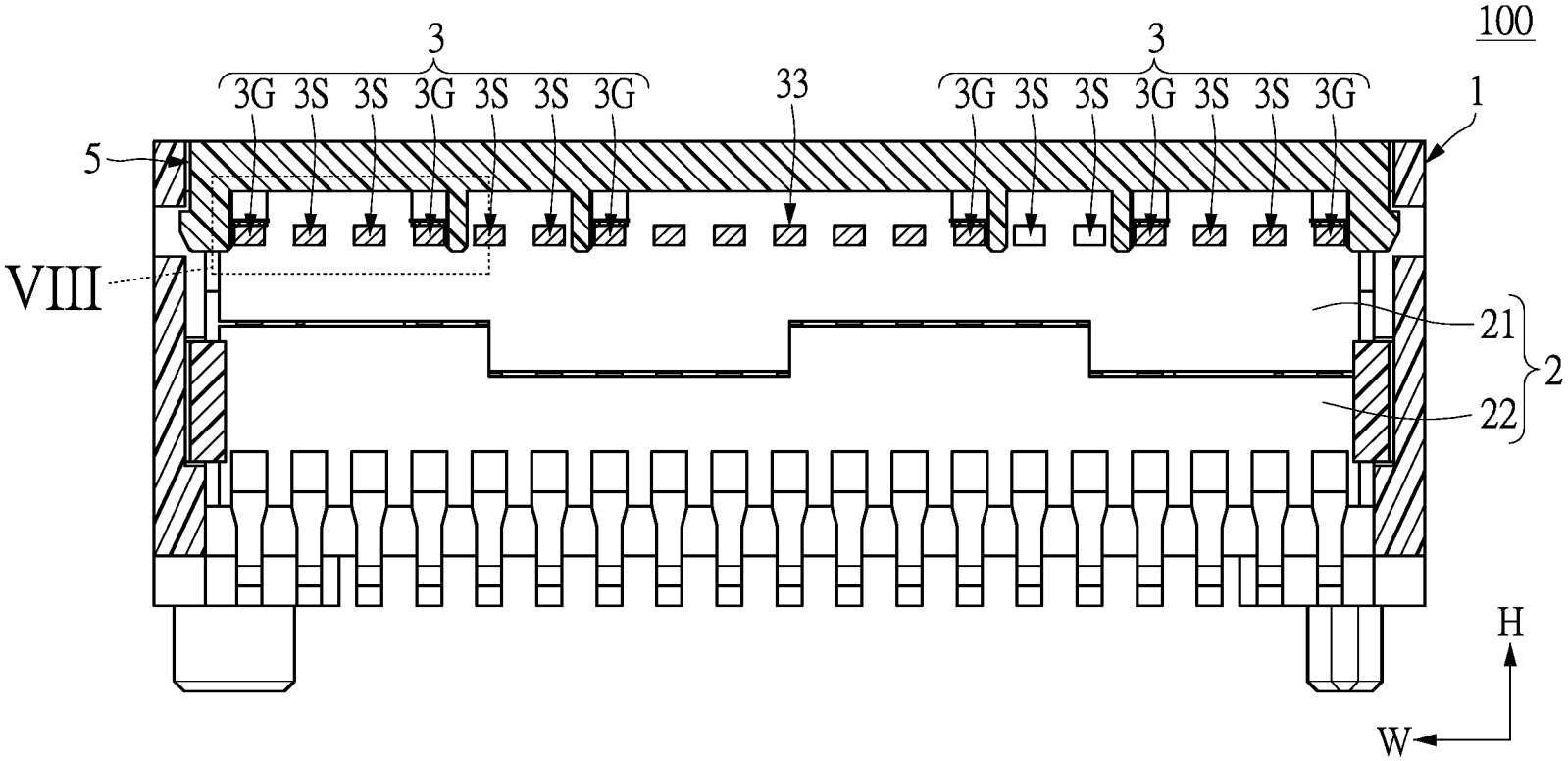
FIG. 7 is a cross-sectional view taken along a cross-sectional line VII-VII of FIG. 4.
Figure 8:
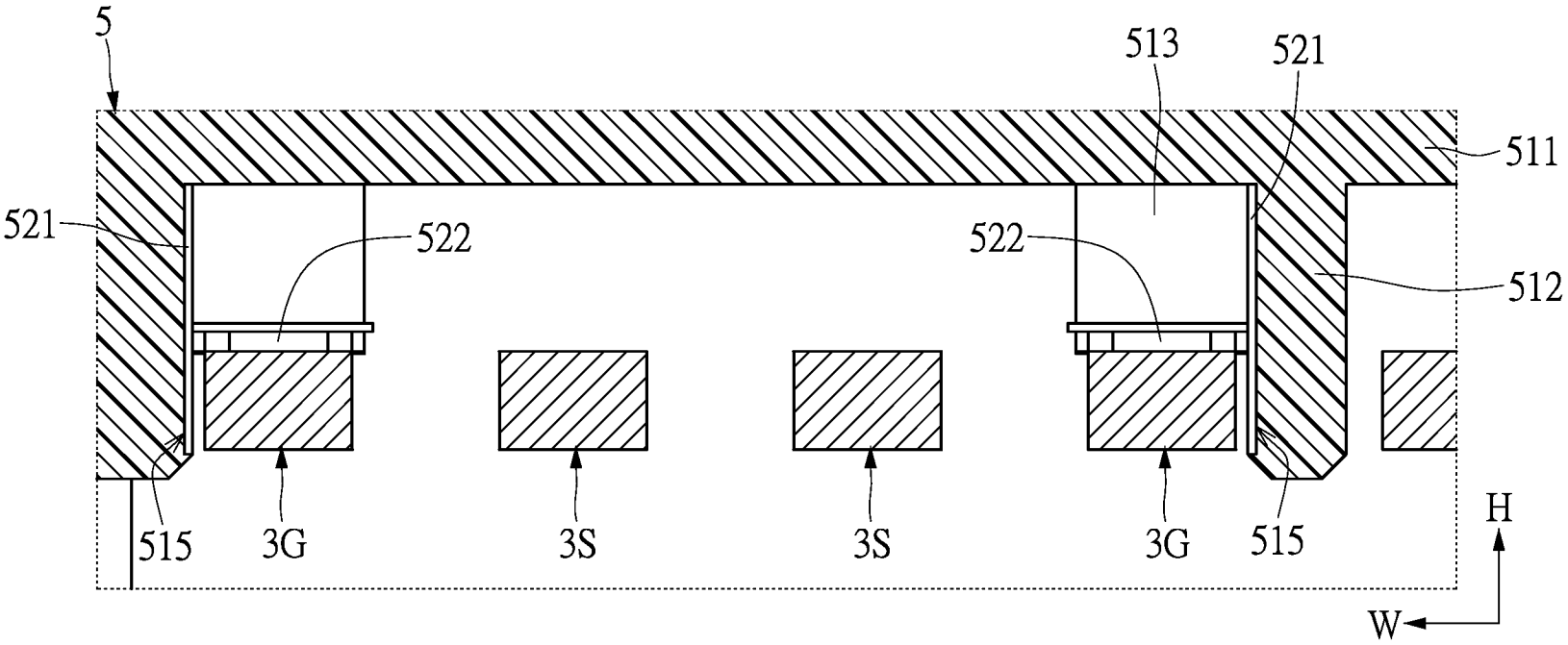
FIG. 8 is an enlarged view showing a portion VIII of FIG. 7.
Figure 9:
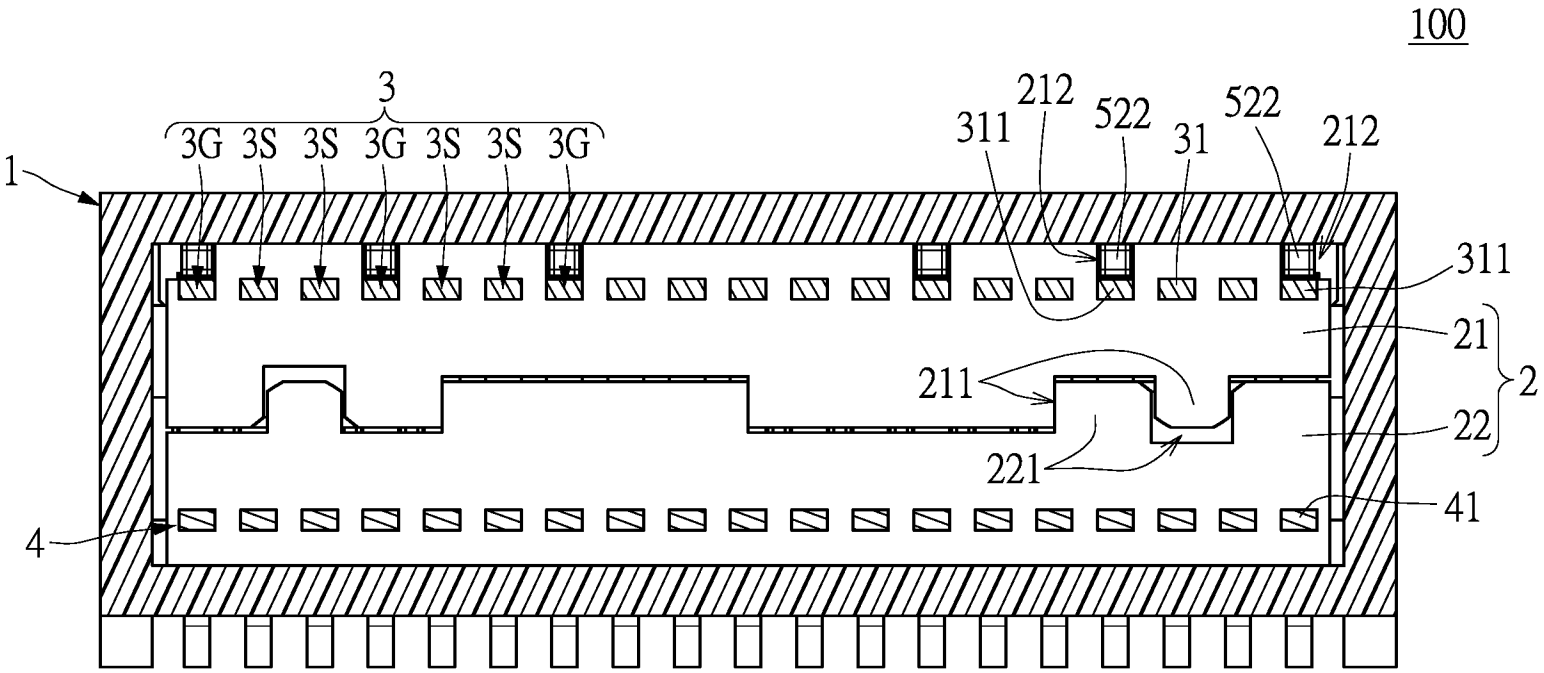
FIG. 9 is a cross-sectional view taken along a cross-sectional line IX-IX of FIG. 4.
Figure 10:
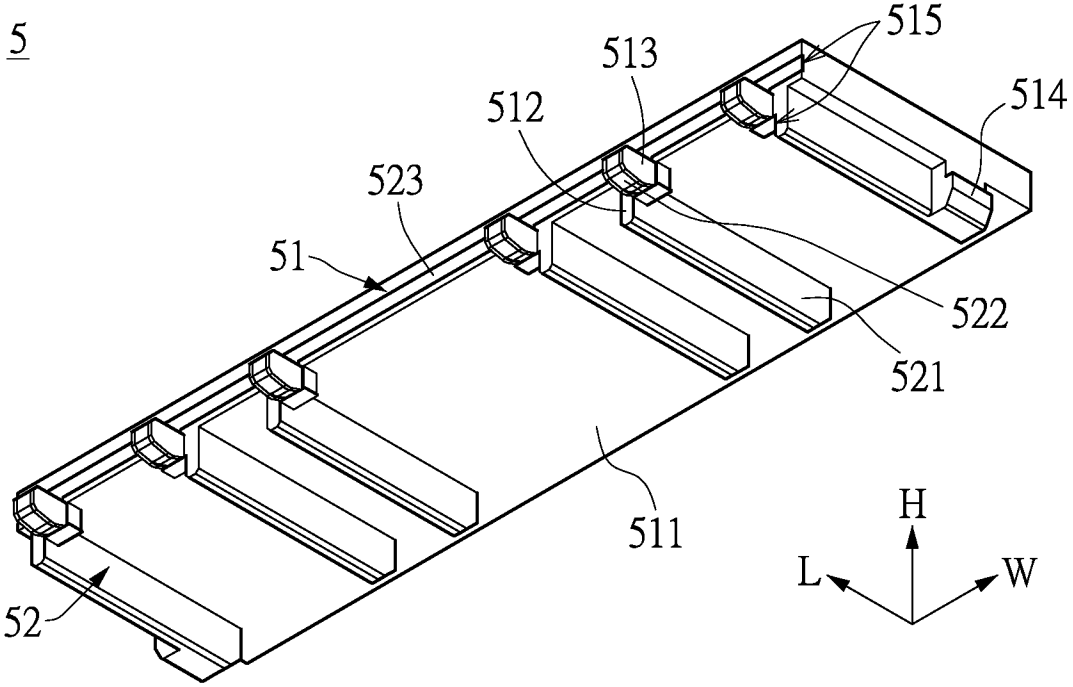
FIG. 10 is a perspective view showing a shielding member of the high speed connector according to the present disclosure.
Figure 11:
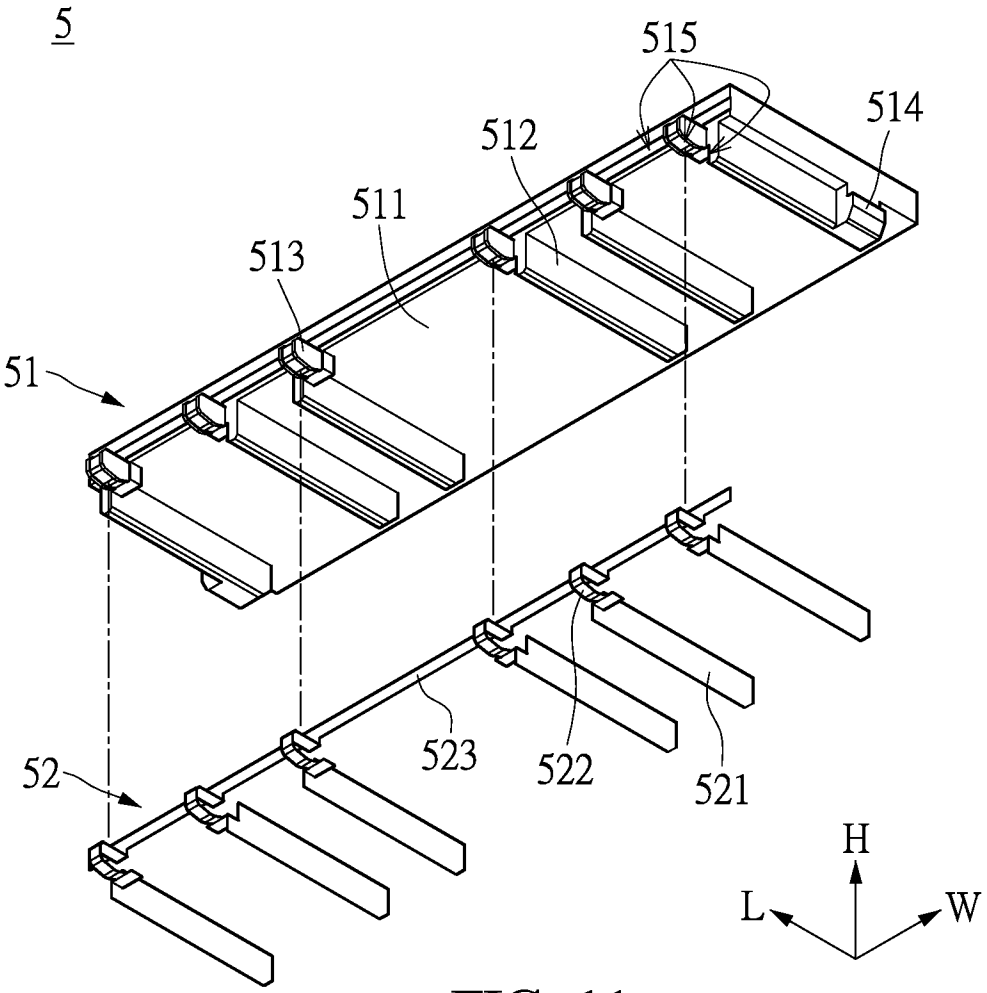
FIG. 11 is an exploded view of FIG. 10.

Moreover, as shown in FIGS. 5 to 9, when the first conductive terminals 3 are named according to function or application thereof, the first conductive terminals 3 includes a plurality pairs of differential signal terminals 3S and a plurality of grounding terminals 3G and the pairs of differential signal terminals 3S and the grounding terminals 3G in the present embodiment are substantially arranged in a bilateral symmetry. The insulating core 2 (i.e., the first plastic core 21) has a plurality of notches 212 (as shown in FIG. 2 or FIG. 9), and parts of the grounding terminals 3G (i.e., a rear portion of the first embedded segment 31 of each grounding terminal 3G) are respectively exposed from the insulating core 2 though the notches 212 and each is defined as an externally connecting portion 311.

Thus, the externally connecting portions 311 are embedded in the insulating core 2 (i.e., the first plastic core 21) having a higher structural strength, so that when each of the externally connecting portions 311 is abutted against the other component (i.e., the shielding member 5), the insulating core 2 can support each of the externally connecting portions 311 to prevent a deformation from occurring, thereby maintaining a stable connection between each of the externally connecting portions 311 and the abutted component.

As shown in FIGS. 2 to 4, the second conductive terminals 4 are arranged in one row parallel to the width direction W, and are fixed on the second plastic core 22. Each of the second conductive terminals 4 is substantially arranged in the housing 1. A length of each of the second conductive terminals 4 is less than or equal to that of each of the first conductive terminals 3. Each of the second conductive terminals 4 has a second embedded segment 41 fixed and embedded in the second plastic core 22 of the insulating core 2, a second contacting segment 42 extended from the second embedded segment 41 toward the inserting opening 113, and a second fixing segment 43 extended from the second embedded segment 41 in a direction away from the inserting opening 113. That is to say, the second contacting segments 42 are respectively arranged in the lower row of the terminal slots 112 of the main portion 11, and each of the second contacting segments 42 is partially located in the inserting channel 111. The second fixing segments 43 are arranged between the two positioning sheets 12.

Specifically, a length of each of the second embedded segments 41 is equal to that of each of the first embedded segments 31, a length of each of the second contacting segments 42 is equal to that of each of the first contacting segments 32, and a length of each of the second fixing segments 43 is less than that of each of the second contacting segments 33.

In other words, as shown in FIGS. 5 to 9, when the second conductive terminals 4 are named according to function or application thereof, the second conductive terminals 4 includes a plurality pairs of differential signal terminals (not labeled) and a plurality of grounding terminals (not labeled), and the arrangement of the differential signal terminals and the grounding terminals of the second conductive terminals 4 are substantially identical to the arrangement of the differential signal terminals 3S and the grounding terminals 3G of the first conductive terminals 3.

As shown in FIGS. 2, 4, 10, and 11, the shielding member 5 in the present embodiment is an LDS shielding member 5, but the present disclosure is not limited thereto. The shielding member 5 includes a substrate 51 and a metallic coating layer 52 coated on the substrate 51. The metallic coating layer 52 is abutted against at least two of the grounding terminals 3G of the first conductive terminals 3 to establish an electrical connection between the at least two abutted grounding terminals 3G. Thus, the substrate 51 having a better structural strength can be configured to support the metallic coating layer 52 by coating the metallic coating layer 52 on the substrate 52, so that the metallic coating layer 52 is not easily deformed.

In should be noted that the substrate 51 in the present embodiment is an LDS plastic. That is to say, the substrate 51 is a portion of the LDS shielding member 5, which is not implemented in the laser structuring and activation process and the chemically coating process, so that the substrate 51 still has the insulating property. However, in other embodiments of the present disclosure, the substrate 51 can be a general plastic, which is not used in the LDS process. Moreover, in the present embodiment, a thickness of the substrate 51 in the width direction W is preferably more than that of the metallic coating layer 52, but the present disclosure is not limited thereto.

The substrate 51 is detachably fastened to the housing 1. The substrate 51 in the present embodiment is integrally formed as one piece, and includes a base portion 511, a plurality of partitions 512, a plurality of protruding portions 513, and two hooks 514. The base portion 511 has a substantially plate-like structure. Each of the partitions 512 having a plate-like structure is perpendicularly connected to a bottom surface of the base portion 511. The protruding portions 513 are connected to a front edge of the base portion 511 and/or the partitions 512. The two hooks 514 are respectively connected to two opposite sides of the base portion 511.

The metallic coating layer 52 includes a plurality of shielding portions 521, a plurality of abutting portions 522 respectively arranged adjacent to the shielding portions 521, and a bridging portion 523 configured to establish an electrical connection between the shielding portions 521 and the abutting portions 522. The shielding portions 521 are respectively coated on the partitions 512, and the abutting portions 522 are respectively coated on the protruding portions 513. The bridging portion 523 is coated on the base portion 511 and is connected to the shielding portions 521 and the abutting portions 522. It should be noted that the metallic shielding layer 52 in the present embodiment is arranged in a concave structure 515 of the substrate 51, but the present disclosure is not limited thereto.

The substrate 51 is fastened to the housing 1 by using the two hooks 514 to respectively buckle with the two positioning sheets 12. The partitions 512 respectively correspond in position to the grounding terminals 3G. The protruding portions 513 of the substrate 51 are respectively arranged in the notches 212 of the first plastic core 21, and the abutting portions 522 are respectively abutted against the externally connecting portions 311 of the grounding terminals 3G. Accordingly, the abutting portions 522 are coated on the protruding portions 513 having a higher structural strength, so that when the abutting portions 522 are respectively abutted against the externally connecting portions 311, the protruding portions 513 can be used to respectively support the abutting portions 522 to prevent a deformation, thereby maintaining a stable connection between each of the abutting portions 522 and the abutted externally connecting portion 311.

Figure 5:
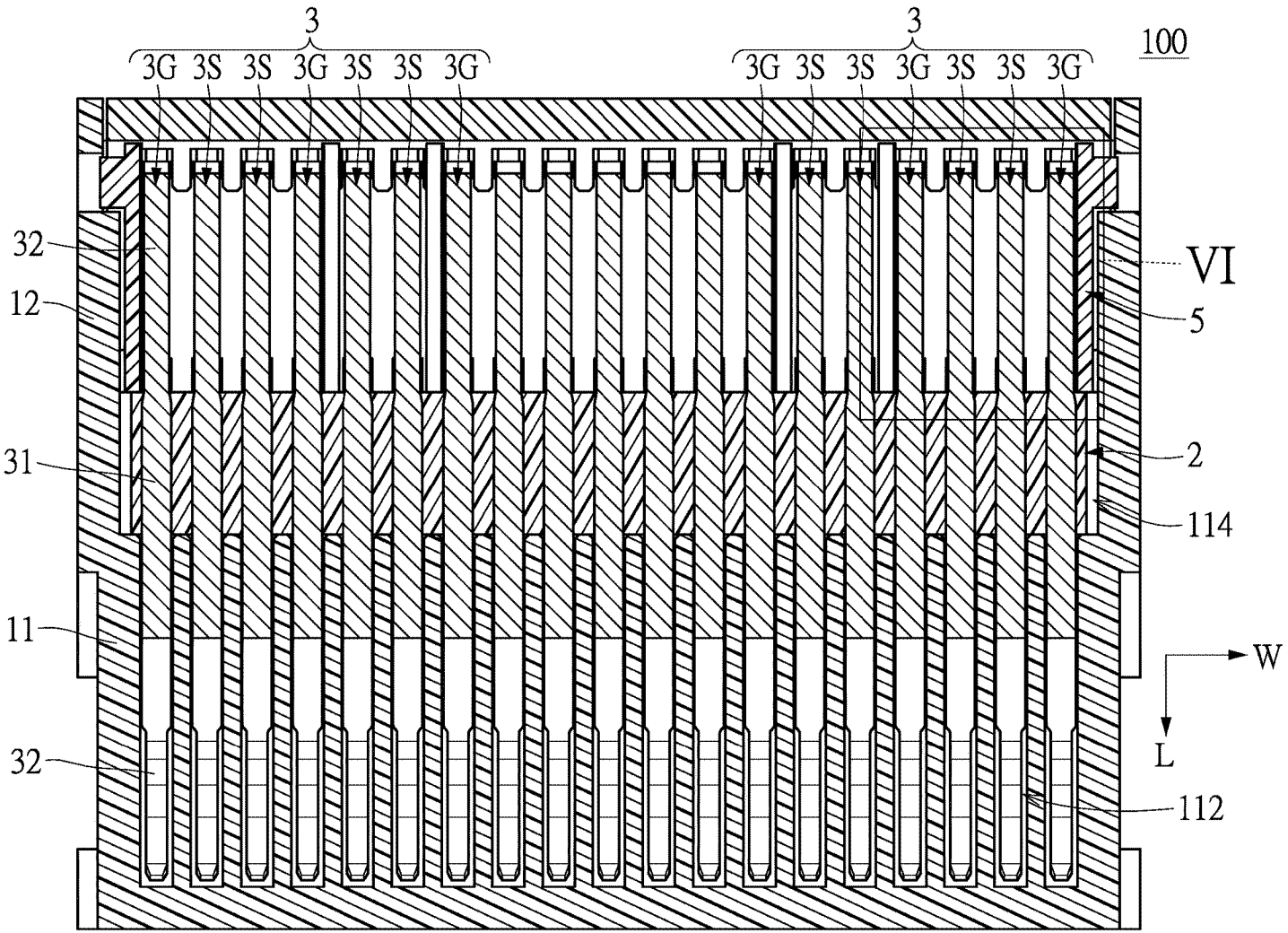
FIG. 5 is a cross-sectional view taken along a cross-sectional line V-V of FIG. 4.

Moreover, as the differential signal terminals 3S and the grounding terminals 3G in the present embodiment are arranged in the bilateral symmetry, and the shielding member 5 is a mirror symmetry structure, the following description just discloses the structure of two differential signal terminals 3S shown in the right side of FIG. 5, two grounding terminal 3G respectively arranged at two opposite outer sides of the said two differential signal terminals 3S, and the corresponding parts of the shielding member 5 for the sake of brevity. Moreover, as shown in FIG. 6 or FIG. 8, the corresponding parts of the shielding member 5 includes two partitions 512, two protruding portions 513, and parts of the metallic coating layer 52 arranged on the two partitions 512 and the two protruding portions 513.

Figure 6:
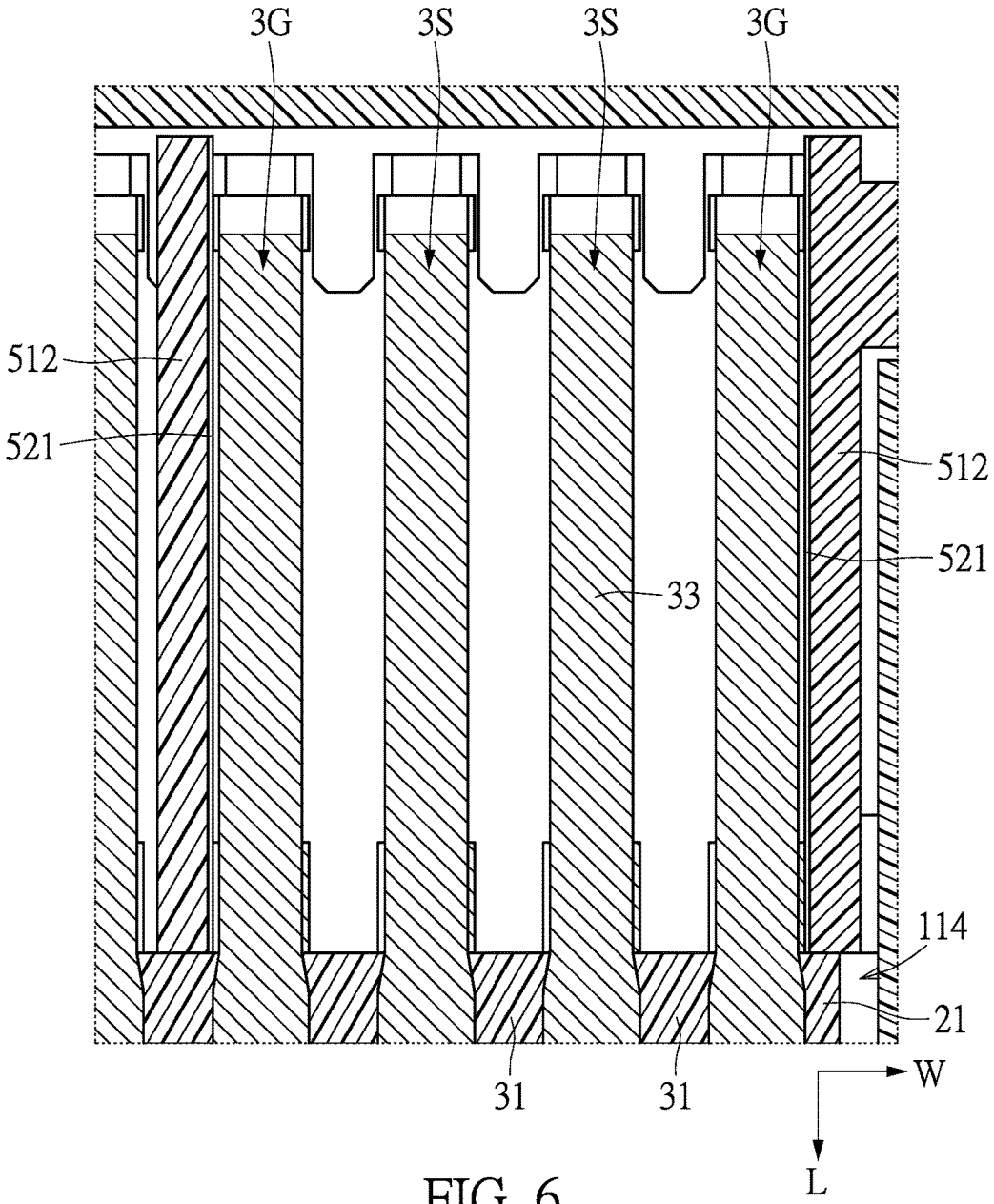
FIG. 6 is an enlarged view showing a portion VI of FIG. 5.

Specifically, as shown in FIGS. 6, 8, and 9, the two partitions 512 are respectively arranged at two opposite sides (i.e., two opposite outer sides) of the two grounding terminals 3G. The two shielding portions 521 are coated on surfaces of the two partitions 512 arranged adjacent to the two grounding terminals 3G (i.e., as shown in FIG. 8, the two shielding portions 521 are respectively coated on surfaces of the two partitions 512 facing to each other). The two abutting portions 522 are respectively coated on the two protruding portions 513, so that when the two protruding portions 513 are respectively arranged in the two notches 212, the two abutting portions 522 are respectively abutted against the externally connecting portions 311 of the two grounding terminals 3G.

Moreover, the two shielding portions 521 of the metallic coating layer 52 are respectively arranged at the two opposite outer sides of the two differential signal terminals 3S, and the metallic coating layer 52 is configured to shield the two differential signal terminals 3S in the width direction W. The two shielding portions 521 of the metallic coating layer 52 are configured to shield at least 25% of each of the first fixing segments 33 of the two differential signal terminals 3S in the width direction W, and the at least 25% of each of the first fixing segments 33 of the two differential signal terminals 3S is arranged adjacent to the insulating core 2. Preferably, the two shielding portions 521 of the metallic coating layer 52 are configured to shield entirely a portion of each of the two differential signal terminals 3S, which is arranged between the insulating core 2 and the bending corner 331 thereof, in the width direction W, but the present disclosure is not limited thereto.

Thus, the shielding member 5 have a shielding function for the differential signal terminals 3S by using the metallic coating layer 52, so that the quality and the performance of signal transmission of the high speed connector 100 in the present embodiment can be effectively improved.

It should be noted that each of the shielding portions 521 in the present embodiment is coated on a surface of the partition 512 being adjacent to the grounding terminal 3G, so that the shielding member 5 can be applied to a condition, that is any two adjacent of the first conductive terminals 3 provided with a smaller gap there-between, for preventing each of the shielding portions 521 from contacting the adjacent differential signal terminal 3S, but the present disclosure is not limited thereto. In other embodiments of the present disclosure, when any two adjacent of the first conductive terminals 3 are provided with a large gap there-between, two opposite surfaces of the partition 512 each can be coated with one shielding portion 521.

In addition, the insulating core 2 (i.e., the first plastic core 21), the first conductive terminals 3 (i.e., the two differential signal terminals 3S and the grounding terminals 3G shown in the left side of FIG. 7), and the shielding member 5 (i.e., parts of the shielding member 5 related to the two differential signal terminals 3S and the grounding terminals 3G) in the present embodiment can be co-defined as a transmission module of the high speed connector 100. The components of the transmission module are not limited to the present embodiment. That is to say, in other embodiments of the present disclosure, the transmission module can be applied to the other high speed connector.

In summary, for the high speed connector (or the transmission module) in the present disclosure, the shielding member has a shielding function for the differential signal terminals by using the metallic coating layer, so that the quality and the performance of signal transmission of the high speed connector (or the transmission module) can be effectively improved.

Moreover, the substrate having a better structural strength can be configured to support the metallic coating layer by coating the metallic coating layer on the substrate, so that the metallic coating layer is not easily deformed.

Specifically, the externally connecting portions are embedded in the insulating core (i.e., the first plastic core) having a higher structural strength, so that the insulating core can support each of the externally connecting portions. The abutting portions are coated on the protruding portions having a higher structural strength, so that the protruding portions can respectively support the abutting portions. Accordingly, when the abutting portions are respectively abutted against the externally connecting portions, the abutting portions and the externally connecting portions are not easily deformed, thereby maintaining a stable connection between each of the abutting portions and the abutted externally connecting portion.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A high speed connector, comprising:

a housing;

an insulating core inserted into the housing;

a plurality of first conductive terminals fixed on the insulating core and arranged in one row parallel to a width direction, wherein each of the first conductive terminals is substantially arranged in the housing, the first conductive terminals include two differential signal terminals and two grounding terminals, and the two grounding terminals are respectively arranged at two opposite outer sides of the two differential signal terminals;

a plurality of second conductive terminals fixed on the insulating core and arranged in one row parallel to the width direction, wherein each of the second conductive terminals is substantially arranged in the housing, and a length of each of the second conductive terminals is less than or equal to that of each of the first conductive terminals; and a shielding member including:

a substrate detachably fastened to the housing; and a metallic coating layer that is coated on the substrate, and that is abutted against the two grounding terminals to establish an electrical connection between the two grounding terminals, wherein the metallic coating layer is arranged at the two opposite outer sides of the two differential signal terminals, and the metallic coating layer is configured to shield the two differential signal terminals in the width direction.

2. The high speed connector as claimed in claim 1, wherein the substrate includes a base portion and two partitions connected to the base portion, the two partitions are respectively arranged at two opposite sides of the two grounding terminals, and a part of the metallic coating layer is coated on surfaces of the two partitions arranged adjacent to the two grounding terminals.

3. The high speed connector as claimed in claim 2, wherein the insulating core has two notches, parts of the two grounding terminals are exposed from the insulating core though the two notches, and each is defined as an externally connecting portion, wherein the substrate includes two protruding portions respectively arranged in the two notches, the metallic coating layer includes two shielding portions, two abutting portions respectively arranged adjacent to the two shielding portions, and a bridging portion configured to establish an electrical connection between the two shielding portions and the two abutting portions, wherein the two shielding portions are respectively coated on surfaces of the two partitions facing to each other, the two abutting portions are respectively coated on the two protruding portions, and the two abutting portions are respectively abutted against the two externally connecting portions.

4. The high speed connector as claimed in claim 1, wherein the housing has an inserting opening, each of the first conductive terminals has a first embedded segment fixed and embedded in the insulating core, a first contacting segment extended from the first embedded segment toward the inserting opening, and a first fixing segment extended from the first embedded segment in a direction away from the inserting opening, wherein the metallic coating layer is configured to shield at least 25% of each of the first fixing segments of the two differential signal terminals in the width direction, and the at least 25% of each of the first fixing segments of the two differential signal terminals is arranged adjacent to the insulating core.

5. The high speed connector as claimed in claim 4, wherein each of the first fixing segments has a bending corner arranged behind a portion thereof extended from the respective embedded segment in a longitudinal direction perpendicular to the width direction, and the metallic coating layer is configured to shield entirely a portion of each of the two differential signal terminals, which is arranged between the insulating core and the bending corner thereof, in the width direction.

6. The high speed connector as claimed in claim 4, wherein each of the second conductive terminals has a second embedded segment fixed and embedded in the insulating core, a second contacting segment extended from the second embedded segment toward the inserting opening, and a second fixing segment extended from the second embedded segment in a direction away from the inserting opening, wherein a length of each of the second embedded segments is equal to that of each of the first embedded segments, a length of each of the second contacting segments is equal to that of each of the first contacting segments, and a length of each of the second fixing segments is less than that of each of the second contacting segments.

7. The high speed connector as claimed in claim 1, wherein the insulating core includes a first plastic core and a second plastic core, the first conductive terminals are fixed on the first plastic core, the second conductive terminals are fixed on the second plastic core, the first plastic core has a rugged structure, the second plastic core has a mating structure, and the first plastic core is fixed on the second plastic core by detachably inserting the rugged structure into and the mating structure.

8. The high speed connector as claimed in claim 1, wherein the shielding member is an LDS shielding member, and the metallic shielding layer is arranged in a concave structure of the substrate.

9. A transmission module of a high speed connector, comprising:

an insulating core;

two differential signal terminals and two grounding terminals, wherein the differential signal terminals and the two grounding terminals are fixed on the insulating core and are arranged in one row parallel to a width direction, and the two grounding terminals are respectively arranged at two opposite outer sides of the two differential signal terminals; and a shielding member including:

a substrate; and a metallic coating layer that is coated on the substrate, and that is abutted against the two grounding terminals to establish an electrical connection between the two grounding terminals, wherein the metallic coating layer is arranged at the two opposite outer sides of the two differential signal terminals, and the metallic coating layer is configured to shield the two differential signal terminals in the width direction.

10. The transmission module of the high speed connector as claimed in claim 9, wherein the shielding member is an LDS shielding member, and the metallic shielding layer is arranged in a concave structure of the substrate, wherein the insulating core has two notches, parts of the two grounding terminals are exposed from the insulating core though the two notches, and each is defined as an externally connecting portion, wherein the substrate includes a base portion, two partitions connected to the base portion, and two protruding portions connected to the base portion, the two partitions are respectively arranged at two opposite sides of the two grounding terminals, the two protruding portions are respectively arranged in the two notches, wherein the metallic coating layer includes two shielding portions, two abutting portions respectively arranged adjacent to the two shielding portions, and a bridging portion configured to establish an electrical connection between the two shielding portions and the two abutting portions, wherein the two shielding portions are respectively coated on surfaces of the two partitions arranged adjacent to the two grounding terminals, the two abutting portions are respectively coated on the two protruding portions, and the two abutting portions are respectively abutted against the two externally connecting portions.

* * * * *